United States Patent [19]

Samsing

[11] 4,191,321

[45] Mar. 4, 1980

[54] CONTAINER HAVING PAPER-BOARD END CAP AND OVAL SLEEVE

[76] Inventor: Rolf A. Samsing, 349 Elm St., Braintree, Mass. 02184

[21] Appl. No.: 974,352

[22] Filed: Dec. 29, 1978

[51] Int. Cl.[2] ..... B65D 5/02

[52] U.S. Cl. ..... 229/5.5; 220/4 R

[58] Field of Search ..... 229/5.5, 5.8, 4.5; 220/4 R

[56] References Cited

U.S. PATENT DOCUMENTS

| | | | |
|---|---|---|---|
| 615,716 | 12/1898 | Kimmard | 229/5.5 |
| 1,186,184 | 6/1916 | Grasberger | 229/5.5 |
| 1,615,254 | 1/1927 | Barker | 229/5.5 |
| 1,947,190 | 2/1934 | Cody | 229/5.5 |
| 2,053,680 | 9/1936 | Page | 229/5.5 |
| 2,134,321 | 10/1938 | Amberg | 229/5.5 X |
| 2,489,616 | 11/1949 | Buttery | 229/5.5 |
| 2,671,593 | 3/1954 | Page | 229/4.5 X |
| 3,700,018 | 10/1972 | Goglio | 229/5.5 |
| 3,986,659 | 10/1976 | Vajtay | 220/4 R X |

*Primary Examiner*—Davis T. Moorhead

[57] ABSTRACT

Disclosed is a paper-board end cap for a tubular central section in the shape of an oval sleeve. The end cap is found from a rectangular paper-board having an oval shaped crease symmetrical about the long axis of the rectangle. The end cap is folded along the crease and inserted into the tubular central section.

6 Claims, 4 Drawing Figures

CONTAINER HAVING PAPER-BOARD END CAP AND OVAL SLEEVE

CROSS REFERENCES TO RELATED APPLICATIONS AND PATENTS

1. L. Vajtay, U.S. Pat. No. 3,913,774, issued on Oct. 21, 1975 for "End Caps For Containers."
2. L. Vajtay, U.S. Pat. No. 3,986,659, issued on Oct. 19, 1976 for "End Caps For Tubular Containers."
3. L. Vajtay, application Ser. No. 912,839, filed June 5, 1978, for "Thermoplastic Container".

BACKGROUND OF THE INVENTION

1. Field of the Invention

This invention relates to end caps for tubular containers and more particularly to an axially inserted end cap frictionally engaging a tubular central section and forming an oval-shaped container.

2. Description of the Prior Art

The above referenced patent application and patents describe various containers having flexible or semi-rigid tubular central sections and relatively rigid end caps. The central sections are normally a thermoplastic material approximately 0.010 to 0.050 inches in thickness, and manufactured in the form of a tube. It is known to form a central section as a flattened thermo-plastic sleeve having a pair of creases. As previously described in the cross-references, various end caps have been found useful, depending on the particular application.

Also known in the prior art is the scoring of desired patterns on paperboard. One application has been for subsequent folding along the score to form three dimensional objects. For example, as will become apparent from the description of the present end cap, when folded, it resembles a toy ship. The prior art, however, has failed to suggest that such a three dimensional object could be fabricated as an end cap for insertion into a tubular central section to form a container having an oval cross sectional shape. Since containers having tubular central sections have numerous applications, there is a continuing need for novel end caps to fulfill the various functional needs with minimal complexity and cost.

SUMMARY OF THE INVENTION

Accordingly, it is an object of this invention to provide an improved tubular container having an oval cross sectional shape.

It is a further object of this invention to provide an end cap that is inserted into a thermo-plastic sleeve to form an oval container.

Lastly, it is an object of this invention to fabricate an improved oval package from a flattened thermo-plastic sleeve.

In accordance with the present invention, a tubular central section is provided. The material is preferably a thermo-plastic semi-rigid sheet material having a thickness in the order of 0.010 to 0.050 inches. The sheet material may be folded flat, forming a pair of creases, and adhesively or thermally joined along a longitudinal seam, forming endless sleeves. It can then be cut to length depending on the desired height of the resultant container.

The end caps of this invention are fabricated from rectangular sheet material, preferably paperboard. An oval shaped crease designed to give maximum return force is formed on the rectangular sheet material about the long axis of the rectangle. When folded along the crease, portions of the rectangular sheet material outside the oval shaped crease fold down substantially perpendicular to the oval-shaped portion. Upon insertion into a suitably dimensional sleeve, a friction fit is established. The return force of the end cap forces portions of the folded down material against the inner surface of the tubular central section.

The above mentioned objects, features and advantages of the invention, together with others inherent in the same, are attained by the embodiments illustrated in the drawings, the same being merely preferred exemplary forms, and are described more particularly hereinbelow.

IN THE DRAWINGS

DETAILED DESCRIPTION

Figure 1:
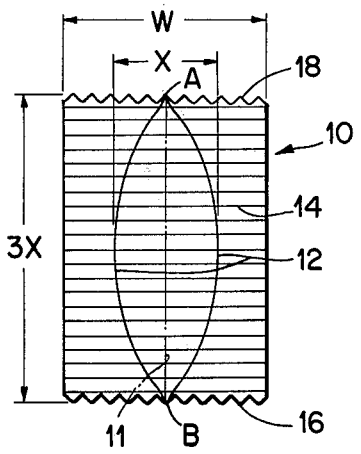
FIG. 1 is an end cap, cut and creased in accordance with the invention.

Referring now to FIG. 1, there is illustrated an end cap 10 in accordance with the present invention. Normally constructed from paperboard, it is cut to the illustrated size and given the crease 12 in one operation. By what is known as a cutting die method, a blade completely severs end cap 10 from the remainder of a larger sheet while a second blade forms creasing rule 12. Although plain paperboard is suitable, corrugation 14 along the grain of the stock improves the return force. When corrugation 14 is not used, the end cap should still be cut with the long dimension (3X) perpendicular to the grain. This provides greater return force in the long sides.

The illustrated oval or elliptical crease 12 has its long axis coincident with the long axis 11 of the rectangular end cap 10, running from point A to point B. Crease 12 extends the full length of the end cap and has a minor axis, illustrated by dimension X, halfway along dimension 3X. This designation has been used because a suitable product has been fabricated with a 3:1 ratio of dimension 3X to X. In fact, as rarely done in patent drawings, FIG. 1 has been drawn to approximate scale. The illustrated dimensions, however, are shown by way of example, not limitation. Operable end caps can be made with various dimensions. Particularly, the width W can be varied significantly, merely affecting the amount of material outside oval crease 12.

End cap 10 is shown with fluted edges 16 and 18. This is optional as edges 16 and 18 could be cut straight. Fluted edges, however, prevent paper cuts from paperboard displays. An additional advantage to the present invention is added friction along the fluted edge after package assembly. Additional advantages can be obtained by laminating end cap 10 with a moisture resistant coating such as aluminum foil (not shown). It is desirable to coat at least one side for moisture proofing from the inside. End cap 10 can also include printing and other information desired to be there presented.

Figure 2:
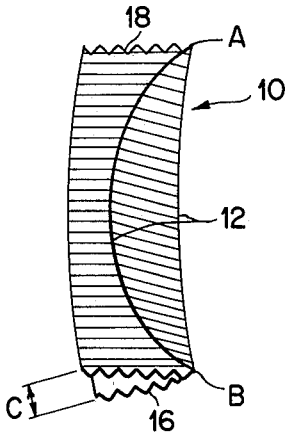
FIG. 2 is an end cap, folded along the crease.

FIG. 2 illustrates end cap 10 folded along crease 12. As the long sides are brought closer together, reducing dimension C, points A and B are brought closer to each other. This provides a lead in taper for insertion into a tubular central section—and snaps back to make frictional contact after insertion.

Figure 3:
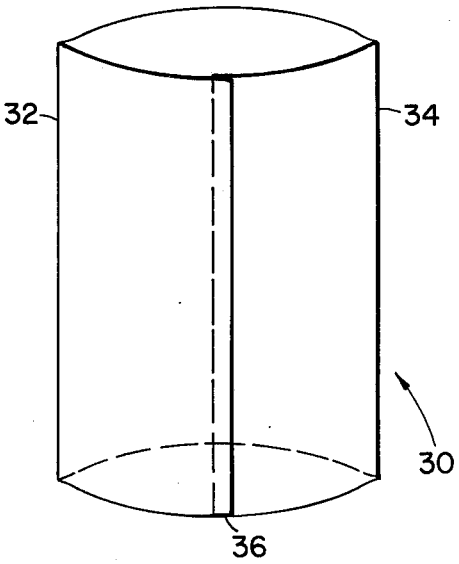
FIG. 3 is a tubular central section.

FIG. 3 illustrates a tubular central section 30. It is usually constructed as a flat thermo-plastic sleeve with crease 32 and crease 34. The thermo-plastic material is joined along longitudinal seam 36. Seam 36 can be joined by any known technique, e.g. thermally or adhesively. Alternatively, a flattened sleeve 30 can be fabricated without a seam 36. The cut length of sleeve 30 determines the height of the completed package.

Figure 4:
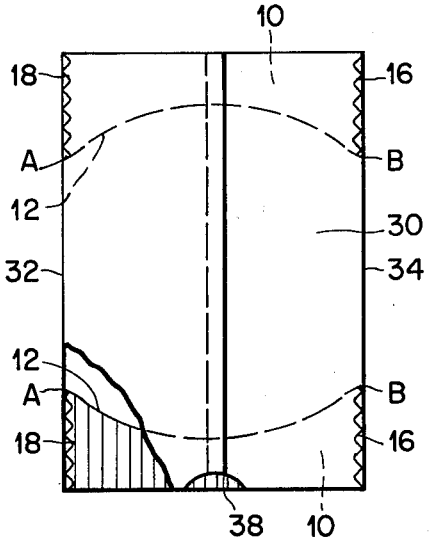
FIG. 4 is an oval container in accordance with the invention.

FIG. 4 illustrates a completed package in accordance with the invention. Creases 32 and 34 of central section 30 remain as the points of the oval cross-section. A pair of end caps 10 have been inserted to form a top and bottom. The portions of end caps 10 within the oval crease 12 form the interior top and bottom—in the shape of a curved elliptical plane. The portions of end cap 10 outside the oval crease 12 are urged against the inner surface of tubular central section 30 by the natural outward return force of the creased paperboard. This frictional force forms and keeps the package together.

Additional friction is provided by the outward force of points A and B as well as fluted edges 16 and 18. Removability of end caps 10 is improved by the addition of finger hole 38 in sleeve 30. Added permanence can be provided by stapling, taping, gluing, etc. Also, since central section 30 is normally transparent, warranty cards and the like can be fastened inside the package bottom—the hollow interior of the usually opaque end cap 10.

While several examples illustrative of preferred embodiments have been described, those skilled in the art will recognize that various changes in the disclosed structures and exemplary methods may be made without departing from the spirit and scope of this invention.

What is claimed is:

1. An improved container having an oval cross-sectional shape, comprising: a tubular central section; an end cap inserted into an end of said tubular central section; said end cap being formed from a rectangular sheet material having an oval shaped crease symmetrical about an axis of the rectangle, folded along the crease such that portions of the rectangular sheet material outside said oval shaped crease frictionally engage said tubular central section; thereby forming a container having an oval cross-sectional shape.

2. A container as in claim 1 wherein the points of said oval crease frictionally engage corresponding creased portions of said tubular central section.

3. A container as in claim 1 wherein said rectangular sheet material has a grain perpendicular to the said axis of the rectangle.

4. A container as in claim 3 wherein said rectangular sheet material is corrugated along said grain.

5. A container as in claim 1 wherein said rectangular sheet material is fluted along two sides.

6. A container as in claim 1 wherein said rectangular sheet material is opaque and said tubular central section is transparent.

* * * * *